US010273782B2

(12) United States Patent
Dhodapkar

(10) Patent No.: US 10,273,782 B2
(45) Date of Patent: Apr. 30, 2019

(54) METHOD FOR PREVENTING WAX DEPOSITION IN OIL WELLS WITH PACKERS

(71) Applicant: Oil India Limited, Duliajan (IN)

(72) Inventor: Prashant Dhodapkar, Duliajan (IN)

(73) Assignee: Oil India Limited, Duliajan (IN)

( * ) Notice: Subject to any disclaimer, the term of this patent is extended or adjusted under 35 U.S.C. 154(b) by 0 days.

(21) Appl. No.: 15/114,543

(22) PCT Filed: Feb. 4, 2015

(86) PCT No.: PCT/IB2015/050843
§ 371 (c)(1),
(2) Date: Jul. 27, 2016

(87) PCT Pub. No.: WO2015/118461
PCT Pub. Date: Aug. 13, 2015

(65) Prior Publication Data

US 2016/0341006 A1 Nov. 24, 2016

(30) Foreign Application Priority Data

Feb. 5, 2014 (IN) ..... 146/KOL/2014

(51) Int. Cl.
*E21B 37/06* (2006.01)
*E21B 37/00* (2006.01)
(Continued)

(52) U.S. Cl.
CPC ..... *E21B 37/00* (2013.01); *E21B 33/12* (2013.01); *E21B 43/124* (2013.01); *E21B 43/123* (2013.01)

(58) Field of Classification Search
CPC ..... E21B 44/06; E21B 41/02; E21B 37/06
(Continued)

(56) References Cited

U.S. PATENT DOCUMENTS 4,328,865 A * 5/1982 Hall ..... E21B 36/00 166/302
5,195,587 A * 3/1993 Webb ..... E21B 43/34 137/172

(Continued)

FOREIGN PATENT DOCUMENTS

EP 2671623 A1 12/2013
WO 0116459 A1 3/2001

OTHER PUBLICATIONS

Ashford et al."Annular Packer Fluids for Paraffin Control: Model Study and Successful Field Application", SPE Production Engineering, Nov. 1990, pp. 351-355.

(Continued)

*Primary Examiner* — Angela M DiTrani Leff
*Assistant Examiner* — Ashish K Varma
(74) *Attorney, Agent, or Firm* — The Webb Law Firm

(57) ABSTRACT

A method for preventing wax deposition in oil wells with packers is disclosed. The method includes feeding a motive fluid from a storage tank to an ejector having a converging section for inlet of the motive fluid, a diverging section for outlet of the motive fluid, and a constricted section with an opening in between the converging section and the diverging section; removing a water and water vapor from an annulus of the oil well using the ejector, wherein flowing of the motive fluid through the converging section and diverging section of the ejector creates a pressure loss and increases the velocity of the motive fluid, which creates suction in the constricted section to evacuate water and vapor from the annulus of the oil well, thereby remediating wax deposition in the oil well.

7 Claims, 3 Drawing Sheets

(51) Int. Cl.
*E21B 43/12* (2006.01)
*E21B 33/12* (2006.01)

(58) Field of Classification Search
USPC ..... 166/304
See application file for complete search history.

(56) References Cited

U.S. PATENT DOCUMENTS

2009/0071646 A1 3/2009 Pankratz et al.
2010/0101798 A1* 4/2010 Simpson ..... E21B 43/124 166/313

OTHER PUBLICATIONS

Babu et al., "Downhole Chemical Addition Owing to Convection in Annular Liquid", Journal of Petroleum Technology, 1994, vol. 46:03, pp. 190-191.
McClaflin et al., "Control of Paraffin Deposition in Production Operations", Journal of Petroleum Technology, 1984, vol. 36:11, pp. 1965-1970.
Willhite et al., "Wellbore Refluxing in Steam-Injection Wells", Journal of Petroleum Technology, 1987, vol. 39:03, pp. 353-362.

* cited by examiner

METHOD FOR PREVENTING WAX DEPOSITION IN OIL WELLS WITH PACKERS

CROSS-REFERENCE TO RELATED APPLICATIONS

This application is the United States national phase of International Application No. PCT/IB2015/050843 filed Feb. 4, 2015, and claims priority to Indian Patent Application No. 146/KOL/2014 filed Feb. 5, 2014, the disclosures of which are hereby incorporated in their entirety by reference.

TECHNICAL FIELD OF THE INVENTION

The present invention relates generally to the remediation of heavy restriction caused by wax deposition in oil wells having packers that have abnormally low wellbore temperatures on account of wellbore reflux. More particularly, the invention provides a method for preventing wellbore cooling, thus minimizing wax deposition in oil wells having packers.

BACKGROUND AND THE PRIOR ART

Crude petroleum liquid, commonly known as 'crude oil', contains varying amounts (1-25% w/v) of paraffin waxes as well as microcrystalline waxes. The waxes are soluble in crude oil at the reservoir temperature and pressure, but crystallize out of solution at lower temperatures/pressures prevailing at the shallower parts of wellbore and the surface production facilities. Therefore, formation of waxy deposits in the inner wall of the production tubing and flowlines is a frequently encountered problem that the oil companies have to deal with. The methods for dealing with the wax deposition problem in the production tubing include scraping with wireline-run tools, thermal or chemical treatments, or a combination of these. Without such measures, there is a likehood of well tubing getting plugged by the waxy deposit, resulting in enormous production loss.

Oilwells are often completed with packers for several reasons such as: stabilization of heading-and-surging type of flow, for isolating different zones, as a part of gas lift completion (an artificial lift method that is resorted to when the oilwell stops flowing on its own), etc. The most common reason for installing packer is to isolate the annular space (formed by the casing inner wall and the production tubing outer wall) that serves as a volume chamber for the lift gas in a gas-lift completion. An oilwell may be completed with gas lift valves and packer much before it stops flowing on its own, in order to avoid a work over later on.

An oilwell with packer often has aqueous fluid (water-based well completion fluid) trapped in the annular space. This water undergoes repeated evaporation in the lower part of the well, where the temperature is higher, and condensation in the upper part of the well where the temperature is lower. This is known as wellbore 'refluxing'. Much of the heat for the evaporation comes from the flowing crude oil. Anomalously low temperatures, therefore, are recorded in wells completed with packers. Consequently, the wax deposition problem in such wells is also very severe. This is depicted in the FIGS. 1-3.

The severity of the problem can be gauged by comparing the well servicing time in flowing wells without packer (1-2 hours) with that required for a well with packer (4-6 hours). Thus, the oil company operators have to devote considerable amount of resources on an ongoing basis (e.g. dedicated wireline unit and crew) for the remediation of wax deposition in oilwells with packers. Occasionally, undesirable incidents such as parting of wireline and loss of scraping tool in the well occur, further aggravating the potential for production loss.

Conventional methods for remediation of severe wax deposition are given here;

One of the most frequently used methods for remediation of severe wax deposition is use of mechanical tools such as wireline-run cutter. This method is also known as scraping. This method has many limitations—the crew has to move to the well location, rig up the cutting tool equipment and carry out the wax cutting operation for several hours. Carrying out such an operation day-after-day is not only resource intensive, but also cumbersome, monotonous and prone to errors by the crew. On account of such errors, 'fishing' may occur, i.e., the scraping tool may part from the wireline and fall into the wellbore. This creates restriction in the well and also may restrict production.

Another method for remediation of severe wax deposition makes use of chemicals to inhibit the formation, growth and adhesion of wax crystals. This involves high cost, since the injection has to be done on a continuous basis. Moreover, a workover operation is required for the installation of mandrel/valve through which the chemical injection can be carried out. Such a workover is not only costly, but also necessitates shutting-in the well, which means lost production. Similarly, use of a downhole heater for raising the temperature of the produced fluid requires a workover and dedicated power at the well site.

A relatively low-cost method described in the literature involves placement of gelled oil in the annulus as a means for achieving thermal insulation and preventing reflux. This is feasible only when a sliding sleeve door has been provided as a part of the well hardware/production tubing. Other limitations of the method are the formulation of an appropriate gelled fluid for the well conditions and the safety hazards involved in handling inflammable hydrocarbon fluids.

Some related prior art document are given here for reference:

U.S. Pat. No. 4,328,865 disclosed a system for controlling wax formation in oil wells using a thermal syphon wherein a confined annular space between the production tube and the oil string casing is provided by means of a plug, or "packer", installed at a point well below the level at which solid waxes begin to deposit out of the exiting crude oil and a plug, or "packer", installed above the point at which waxes would otherwise stop depositing out of the exiting crude oil and thereafter filling the confined annulus with a fluid working medium. The quantity and properties of the fluid working medium are arranged such that the medium is vaporized at the lower extremeties of the confined annulus and condensed on the surfaces of the upper regions of the confined annulus, particularly in the zone of wax deposition. The condensation process warms the production tube sufficiently to prevent formation of adhesive wax deposits or, alternatively, reliquifies a thin film of deposited wax which enables the flowing crude oil to remove the deposited wax. The condensed working medium flows by gravity to the lower part of the confined annulus where it again becomes available for vaporization and subsequent condensation. No external power is used for this circulation which is caused solely by temperature differences between lower and higher levels of the annulus.

There are some limitations of the approach described in above cited document: (a) Implementing the method will necessitate changing the well completion to a more complicated completion—a pair of packers, a capillary tube, a modified tubing hanger that allows the capillary to pass through it, etc. (b) Changing the well completion to install two packers requires a workover, hence involves costs/shutdowns/risks etc. (c) Providing the required amount of liquid/vapour between the packers and maintaining well control during workover is difficult (d) Liquids/vapours such as pentane are hazardous (e) the heat released during the condensation of liquid may not be sufficient to prevent wax deposition.

Some prior art literature document given here for reference:

"Annular packer fluids for paraffin control: model study and successful field application" J. D. Ashford, et. al; SPE Production Engineering, November 1990: This paper covers the evolution, full-scale model study, and field application of gelled packer fluids for paraffin control in naturally flowing wells. Field application of these insulating packer fluids has resulted in significant increases in the flowing tubing temperature in the seven wells treated to date. The temperature increases from gelled-packer-fluid application alone have eliminated paraffin problems previously controlled with repeated hot-oil treatments. Before this previously controlled with repeated hot-oil treatments. Before this application, chemical inhibition attempts were unsuccessful. The gelled fluid currently used is based on a phosphate ester and sodium aluminate reaction that produces an aluminium phosphate ester association polymer. The gellant is commonly used in oil-based fracturing fluids polymer. The gellant is commonly used in oil-based fracturing fluids.

"Wellbore refluxing in steam injection wells" G. P. Willhite, Journal of Petroleum Technology, March 1987": This document provides that recent field experience has shown that the annulus does not dry out in insulated steam injection wells. Data were presented demonstrating the existence of refluxing in the wellbore which maintained the casing temperature at a constant value consistent with the annulus pressure. Casing temperatures under refluxing conditions were maintained at 212° F. when the annulus pressure was 1 atm while the casing temperature in a dry annulus was expected to be about 130° F. Because of this, heat losses were higher than anticipated which offset some of the economic benefits of using an insulated tubing string.

"Control of paraffin deposition in production operations" G. G. McClaflin and D. L. Whitfill, Journal of Petroleum Technology, November 1984: This document provide that significant operating costs are incurred from treatments designed to remove waxy deposits from production tubing or squeeze treatments designed to inhibit wax deposition. The costs are further increased by formation damage and loss of production that may result from these treatments. Our studies show that paraffin deposition can be prevented or greatly retarded by using chemical surfactants known as dispersants. Two specific surfactants were selected that proved to be very effective paraffin dispersants. One is oil soluble and the other is water soluble. These dispersants can be continuously injected into the well or they can be added in larger quantities in a "batch treatment" at specific time intervals. The choice of whether to use batch or continuous treatment is governed by the type and number of wells requiring treatment.

Therefore, it is apparent from the documents as described herein above that the conventional methods and ones existing in the prior art provide various disadvantages which affect the production of the oil in oil wells having packers and are not cost effective. The present invention provides a cost effective method for preventing wax deposition in oil well having packers and this method is less time consuming and helps in increasing the production and reducing the labor work.

OBJECTS OF THE INVENTION

A basic object of the present invention is to overcome the disadvantages/drawbacks of the known art.

Another object of the present invention is to provide a method for reducing wax deposition in oil wells having packers.

Another object of the present invention is to provide a method which prevents the wellbore cooling for reducing wax deposition in oil wells having packers.

Another object of the present invention is to provide a method which is simple to perform and increase the production without shutting down the oil wells during removal of wax from wellbore.

Yet another object of the present invention is to provide a cost effective and less time consuming operation for preventing the wax deposition in oil wells having packers.

These and other advantages of the present invention will become readily apparent from the following detailed description read in conjunction with the accompanying drawings.

SUMMARY OF THE INVENTION

The following presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

According to an aspect of the present invention there is provided a method for preventing the wax deposition in oil wells having packer(s), said method comprising steps of:

feeding a motive fluid from a storage means to an ejector means having a converging section for inlet of the said motive fluid, a diverging section for outlet of the said motive fluid at a reasonable rate and a constricted section with an opening in between said converging section and said diverging section;

removing a water and water vapor from the annulus of the oil well having packers using said ejector means, wherein flowing of said motive fluid through said converging section and diverging section of said ejector means creates a pressure loss and increase the velocity of said motive fluid, which creates suction in said constricted section to evacuate water and vapour from the annulus of the oil well, thereby remediating wax deposition in the oil wells having packer.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE ACCOMPANYING DRAWINGS

The following drawings are illustrative of particular examples for enabling methods of the present invention, are descriptive of some of the methods, and are not intended to limit the scope of the invention. The drawings are not to scale (unless so stated) and are intended for use in conjunction with the explanations in the following detailed description.

Figure 1:
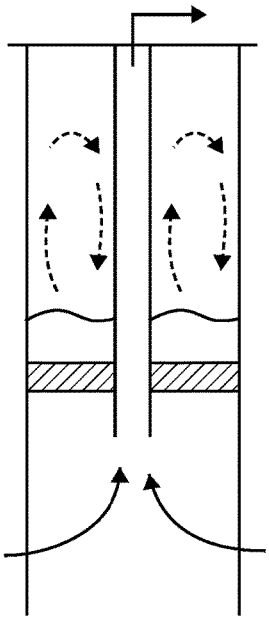
FIG. 1 illustrates a schematic of an oil well with a packer.
Figure 2:
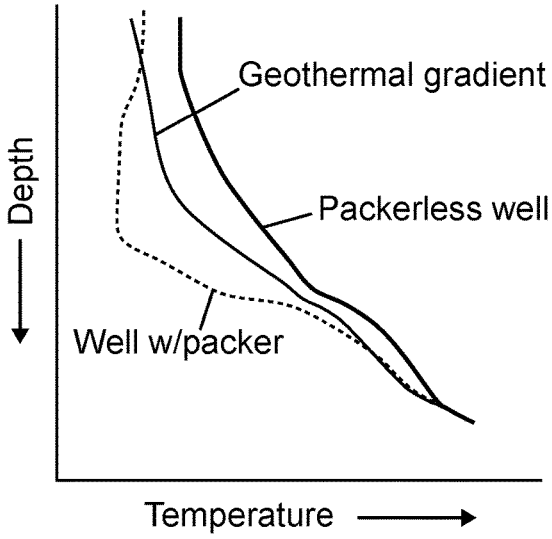
FIG. 2 illustrates comparative temperature profiles for oil wells with and without packers.
Figure 3:
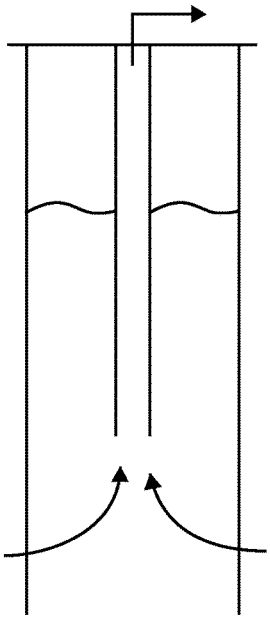
FIG. 3 illustrates a schematic of an oil well without packers.

Persons skilled in the art will appreciate that elements in the figures are illustrated for simplicity and clarity and may have not been drawn to scale. For example, the dimensions of some of the elements in the figure may be exaggerated relative to other elements to help to improve understanding of various exemplary embodiments of the present disclosure. Throughout the drawings, it should be noted that like reference numbers are used to depict the same or similar elements, features, and structures.

DETAILED DESCRIPTION OF THE INVENTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Accordingly, the present invention provides a method for preventing wax deposition in oilwells with packers.

The present invention pertains to minimizing the problem of wax deposition in oilwells and pertains to prevention of wellbore cooling in oilwells (100) with packers (106). The present invention allows removal of aqueous fluid from the annulus of the oilwell through the use of a suitable tool such as a vapor/liquid ejector (venturi), without resorting to costly and time-consuming workover operations.

Although the problem of wax deposition occurs in a number of oilwells, the phenomenon of wellbore reflux and associated problem of severe wax deposition is specific to oilwells with packers. The present invention relates to the solution to the problem of wax deposition due to wellbore reflux and hence is restricted to oilwells with packers.

Figure 4:
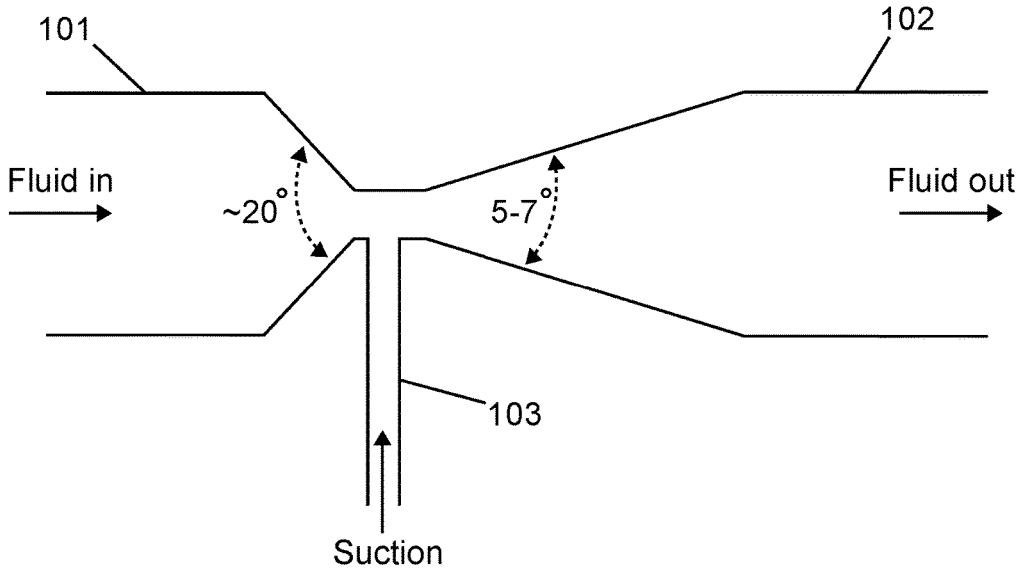
FIG. 4 illustrates the construction of the venturi for minimizing the wax deposition in oil wells.

The details of the venturi constructed for minimizing the wax deposition are shown in the FIG. 4. The venturi consists of a converging section (101), a diverging section (102) and a constriction (103) which has an opening and connection for suction. Flow of a liquid such as water (process water, fresh water, etc. available at site), known as the motive fluid, through the converging/diverging section (101, 102) causes pressure loss and increase in velocity of the flowing liquid. This creates suction that can be utilized to evacuate water/vapour from the annulus (107) of an oilwell (100) with packer (106), and hence remediate excessive wellbore cooling and paraffin wax deposition on the inner walls of production tubing.

The advantages of using a ejector means (suction device) is that (i) It is simple to use (ii) In absence of devices such as sliding sleeve on the bottom of production tubing, no other means (such as a pump) can be used for displacing or removing the water from annulus.

The candidate well wherein the embodiment can be used is selected on the basis of completion and production characteristics as well as the well servicing records. A typical candidate well has a packer (106), it is self-flowing or gas lifted, needs to be scraped daily for wax removal, and has liquid level near to or below the operating valve and/or above the packer (106). The presence of liquid in the annulus (107) can be confirmed with the help of instruments such as echometer. A flowing temperature survey, as well as comparison of flowing temperatures with nearby wells, confirms the presence of reflux in the well.

Figure 5:
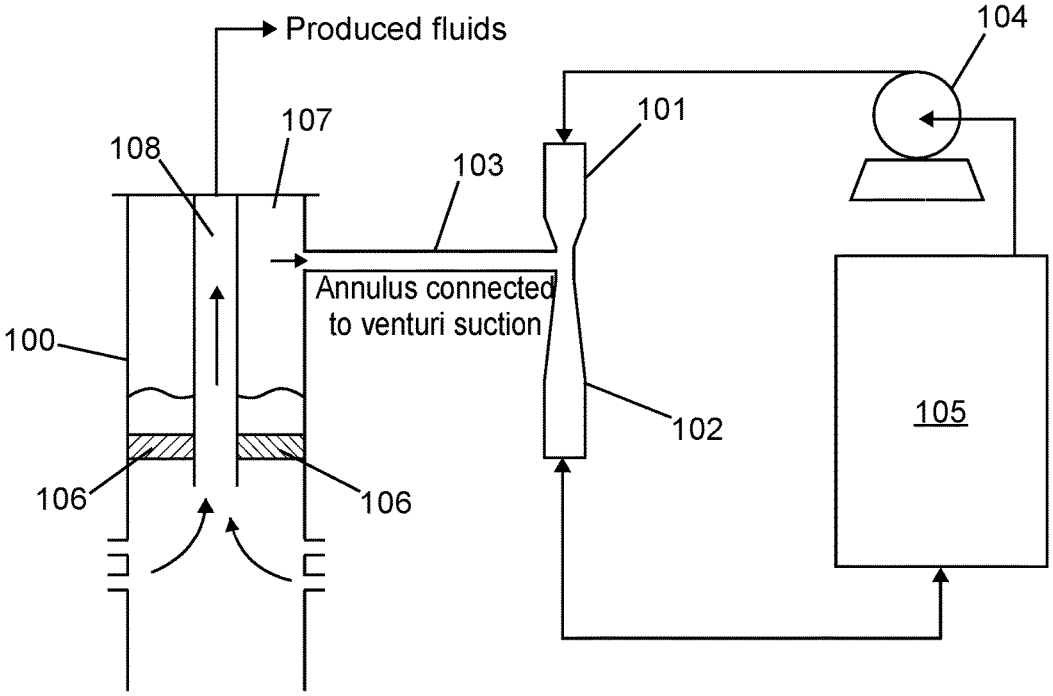
FIG. 5 illustrates the wellsite arrangement of venturi for minimizing the wax deposition in oil wells.

The manner in which the invention is to be used for achieving wax remediation in an oilwell (100) completed with packer (106), as shown in FIG. 5, described with an embodiment that follows. The suction part (103) of the venturi is connected to the casing-tubing annulus (107). The motive fluid is stored in a tank (105) located at the wellsite. A pump (104), whose discharge is connected to the inlet of the venturi, is used for moving the motive fluid through the venturi. After passing through the venturi, the motive fluid returns to the storage tank. Pumping rates employed are, but not limited to, in the range of 150 to 1500 liters per minute (lpm). It is desirable to have a suction size large enough (at least 0.5 inch to 1 inch) so that water/vapour can be removed at a reasonable rate. The wellsite arrangement for carrying out the embodiment is depicted in the diagram below:

Based on the liquid level in the annulus (107) and the packer setting depth, the volume of the liquid to be unloaded is calculated. The annular fluid is evacuated through the suction of the venturi, flows along with the motive fluid in the diverging section (102) of the venturi, and flows out into the storage tank (105). Therefore, the level in the storage tank (105) is expected to increase progressively and hence extra capacity in the storage tank has to be provided for. Once the calculated amount of liquid has been unloaded, the pumping of the motive fluid is stopped. The complete unloading of annular fluid can also be confirmed through echometer survey. The effectiveness of the method is confirmed through an optional temperature survey, and running in the scrapers to judge the elimination or minimization of wax deposition tendency.

Alternative embodiments of the apparatus include use of compressed air/gas as motive fluid. Also, instead of water and storage tank, wellsite pit water may be used as the motive fluid. More than one venturi may be used (in series or parallel) for faster unloading of the annular liquid.

Advantages:

Some of the main advantages of the invention over the prior art are:

1. There is no need for costly consumables or special formulations
2. The invention involves one time operation to remove aqueous fluid from the well
3. The invention is simple to perform and does not involve shutdown or loss of production
4. The effectiveness of the invention can be readily ascertained.

Application:

1. The apparatus can be used to minimize the wax deposition problem in following type of oilwells: Wells which are self-flowing, but have been completed with gas lift valves and packer so that artificial lift can be implemented at a later date. The applicability of this apparatus to such wells can be ascertained through available data such as the annular liquid level, wellbore flowing temperature profile and the scraping data/schedule.
2. In gas-lift wells, where the presence of water in the casing-tubing annulus causes wellbore cooling and wax deposition in the production tubing. The well production data such as frequency of scraping operations, annular liquid level and flowing temperature profile, etc. helps in determining whether the well is a potential candidate for application of the invention.

The potential number of wells where this invention can be used is very large, since approximately 40-60% of wells in mature oilfields require artificial lift. Gas lift being a predominant method of artificial lift, it is expected that a large number of wells are completed with packers and experience anomalous wellbore cooling.

The invention claimed is:

1. A method for preventing wax deposition in an oil well having one or more packers, said method comprising steps of:

feeding a motive fluid from a storage tank to an ejector having a converging section for inlet of the motive fluid, a diverging section for outlet of the motive fluid, and a constricted section with an opening in between said converging section and said diverging section; and removing water and water vapour, using said ejector, from an annulus chamber of an oil well, wherein the said annulus chamber is bound by a casing inner surface, a tubing outer surface, a wellhead at an upper end and a packer at a lower end, wherein flowing of said motive fluid through said converging section and diverging section of said ejector creates a pressure loss and increases the velocity of said motive fluid, which creates suction in said constricted section to evacuate the water and the water vapour from the annulus chamber, thereby remediating wax deposition due to wellbore reflux in the oil well having one or more packers.

2. The method as claimed in claim 1, wherein said motive fluid is selected from the group comprising process water, fresh water, compressed air/gas, wellsite pit water, and any combinations thereof.

3. The method as claimed in claim 1, wherein the presence of said water and vapour in said annulus is validated using an echo-meter.

4. The method as claimed in claim 1, wherein said constricted section is connected to said annulus for suction.

5. The method as claimed in claim 1, wherein a pump is provided with said storage tank for pumping of said motive fluid in and out from said ejector.

6. The method as claimed in claim 5, wherein rate of said motive fluid pumping is 150 to 1500 liters per minute.

7. The method as claimed in claim 1, wherein the oil well is self-flowing.

* * * * *